US011105227B2

(12) United States Patent
Eriksson et al.

(10) Patent No.: US 11,105,227 B2
(45) Date of Patent: Aug. 31, 2021

(54) HIGH FREQUENCY SWITCHING VARIABLE CAM TIMING PHASER

(71) Applicant: SCANIA CV AB, Södertälje (SE)

(72) Inventors: Mikael Eriksson, Torslanda (SE); Daniel Olovsson, Södertälje (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 16/301,940

(22) PCT Filed: Apr. 11, 2017

(86) PCT No.: PCT/SE2017/050357
§ 371 (c)(1),
(2) Date: Nov. 15, 2018

(87) PCT Pub. No.: WO2017/204709
PCT Pub. Date: Nov. 30, 2017

(65) Prior Publication Data

US 2019/0186308 A1 Jun. 20, 2019

(30) Foreign Application Priority Data

May 24, 2016 (SE) ..... 1650711-3

(51) Int. Cl.
*F01L 1/344* (2006.01)

(52) U.S. Cl.
CPC ..... *F01L 1/34409* (2013.01); *F01L 1/3442* (2013.01); *F01L 2001/3443* (2013.01); *F01L 2001/34433* (2013.01); *F01L 2820/01* (2013.01)

(58) Field of Classification Search
CPC ..... F01L 1/3442; F01L 2001/34426; F01L 1/34409; F01L 2001/3443;
(Continued)

(56) References Cited

U.S. PATENT DOCUMENTS 5,056,477 A 10/1991 Linder et al.
5,291,860 A 3/1994 Quinn
(Continued)

FOREIGN PATENT DOCUMENTS

CN 1495345 A 5/2004
CN 101952560 A 1/2011
(Continued)

OTHER PUBLICATIONS

International Search Report for International Patent Application No. PCT/SE2017/050357 dated Aug. 9, 2017.
(Continued)

*Primary Examiner* — Patrick Hamo
*Assistant Examiner* — Wesley G Harris
(74) *Attorney, Agent, or Firm* — Moore & Van Allen PLLC; W. Kevin Ransom

(57) ABSTRACT

A variable cam timing phaser arrangement is disclosed, comprising: a rotor having at least one vane; a stator co-axially surrounding the rotor, having at least one recess for receiving the at least one vane of the rotor, wherein the at least one vane divides the at least one recess into an first chamber and a second chamber; and a control assembly for regulating hydraulic fluid flow from the first chamber to the second chamber or vice-versa. The control assembly comprises a central on/off piloted valve for allowing or preventing fluid communication between the first and second chambers, and a remotely located solenoid-controlled actuator for controlling the on/off piloted valve. The present disclosure further relates to a method of controlling the timing of a camshaft in an internal combustion engine. The disclosure also relates to an internal combustion engine and a vehicle comprising the disclosed variable cam timing phaser arrangement.

15 Claims, 8 Drawing Sheets

(58) Field of Classification Search
CPC ..... F01L 2001/34433; F01L 2820/01; F01L 2001/34469; F01L 1/344; F01L 1/34; F01L 2001/34423
USPC ..... 123/90.17, 90.15, 90.31
See application file for complete search history.

(56) References Cited

U.S. PATENT DOCUMENTS

| | | | | |
|---|---|---|---|---|
| 5,421,711 | A * | 6/1995 | Newton | F01L 25/063 417/401 |
| 6,481,402 | B1 * | 11/2002 | Simpson | F01L 1/022 123/90.12 |
| 6,622,675 | B1 | 9/2003 | Simpson | |
| 6,666,181 | B2 | 12/2003 | Smith et al. | |
| 9,080,471 | B2 * | 7/2015 | Pluta | F01L 1/34409 |
| 2002/0088413 | A1 | 7/2002 | Smith et al. | |
| 2003/0196616 | A1 | 10/2003 | Simpson | |
| 2004/0211379 | A1 * | 10/2004 | Palesch | F01L 1/34 123/90.17 |
| 2006/0086332 | A1 | 4/2006 | Simpson et al. | |
| 2007/0028874 | A1 | 2/2007 | Simpson | |
| 2007/0107684 | A1 | 5/2007 | Takahashi et al. | |
| 2007/0215084 | A1 * | 9/2007 | Pluta | F01L 1/022 123/90.17 |
| 2008/0135004 | A1 | 6/2008 | Simpson et al. | |
| 2009/0071140 | A1 | 3/2009 | Knecht et al. | |
| 2011/0017156 | A1 * | 1/2011 | Smith | F01L 1/3442 123/90.15 |
| 2013/0000576 | A1 | 1/2013 | Tanaka et al. | |
| 2013/0180486 | A1 * | 7/2013 | Smith | F01L 1/3442 123/90.17 |
| 2014/0251247 | A1 | 9/2014 | Tewes et al. | |
| 2014/0261263 | A1 * | 9/2014 | Smith | F01L 1/3442 123/90.15 |
| 2016/0130988 | A1 * | 5/2016 | Smith | F01L 1/3442 123/90.17 |

FOREIGN PATENT DOCUMENTS

| | | | |
|---|---|---|---|
| CN | 105473828 | A | 4/2016 |
| DE | 202004021243 | U1 | 4/2007 |
| DE | 102008001801 | A1 | 11/2009 |
| DE | 102008002461 | A1 | 12/2009 |
| DE | 102011055651 | A1 | 5/2013 |
| DE | 102014218547 | A1 | 3/2016 |
| DE | 102014220578 | A1 | 4/2016 |
| EP | 1221540 | A2 | 7/2002 |
| EP | 1357261 | A2 | 10/2003 |
| JP | 2010065593 | A | 3/2010 |
| WO | 2012061233 | A2 | 5/2012 |

OTHER PUBLICATIONS

Written Opinion of the International Searching Authority for International Patent Application No. PCT/SE2017/050357 dated Aug. 9, 2017.
Swedish Office Action of International Patent No. 1650711-3 dated Dec. 16, 2016.
Technology Search Report of the International Searching Authority for International Patent No. 1650711-3 dated Apr. 14, 2016.
Scania CV AB, International Application No. PCT/SE2017/050357, International Preliminary Report on Patentability, dated Nov. 27, 2018.
Scania CV AB, Chinese Patent Application No. 2017800314227, First Office Action, dated Apr. 2, 2020.

* cited by examiner

HIGH FREQUENCY SWITCHING VARIABLE CAM TIMING PHASER

CROSS-REFERENCE TO RELATED APPLICATIONS

This application is a national stage application (filed under 35 § U.S.C. 371) of PCT/SE2017/050357, filed Apr. 11, 2017 of the same title, which, in turn, claims priority to Swedish Application No. 1650711-3, filed May 24, 2016; the contents of each of which are hereby incorporated by reference.

FIELD OF THE INVENTION

The present invention concerns a variable cam timing phaser arrangement for an internal combustion engine as well as a method for controlling the timing of a camshaft in an internal combustion engine using such a variable cam timing phaser. The invention also concerns an internal combustion engine and a vehicle comprising such a variable cam timing phaser arrangement.

BACKGROUND OF THE INVENTION

The valves in internal combustion engines are used to regulate the flow of intake and exhaust gases into the engine cylinders. The opening and closing of the intake and exhaust valves in an internal combustion engine is normally driven by one or more camshafts. Since the valves control the flow of air into the engine cylinders and exhaust out of the engine cylinders, it is crucial that they open and close at the appropriate time during each stroke of the cylinder piston. For this reason, each camshaft is driven by the crankshaft, often via a timing belt or timing chain. However, the optimal valve timing varies depending on engine load. In a traditional camshaft arrangement the valve timing is fixedly determined by the relation of the camshaft and crankshaft and therefore the timing is not optimized over the entire engine operating range, leading to impaired performance, lower fuel economy and/or greater emissions. Therefore, methods of varying the valve timing depending on engine conditions have been developed.

One such method is hydraulic variable cam phasing (hVCP). hVCP is one of the most effective strategies for improving overall engine performance by allowing continuous and broad settings for engine-valve overlap and timing. It has therefore become a commonly used technique in modern compression-ignition and spark-ignition engines.

Both oil-pressure actuated and cam torque actuated hydraulic variable cam phasers are known in the art.

The oil-pressure actuated hVCP design comprises a rotor and a stator mounted to the camshaft and cam sprocket respectively. Hydraulic oil is fed to the rotor via an oil control valve. When phasing is initiated, the oil control valve is positioned to direct oil flow either to an advance chamber formed between the rotor and stator, or a retard chamber formed between the rotor and stator. The resulting difference in oil pressure between the advance chamber and the retard chamber makes the rotor rotate relative to the stator. This either advances or retards the timing of the camshaft, depending on the chosen position of the oil control valve.

The oil control valve is typically a three-positional spool valve that can be positioned either centrally, i.e. co-axially with the camshaft, or remotely, i.e. as a non-rotating component of the hVCP arrangement. This oil control valve is typically regulated by a variable force solenoid (VFS), which is stationary in relation to the rotating cam phaser (when the oil control valve is centrally mounted). The variable force solenoid and the spool valve have three operational positions: one to provide oil to the advance chamber, one to provide oil to the retard chamber, and one to refill oil to both chambers (i.e. a holding position).

The established oil pressure actuated hVCP technology is effective in varying valve timing, but has relatively slow phasing velocities and high oil consumption. Therefore, the latest iterations of hVCP technology utilize a technique known as cam torque actuation (CTA). As the camshaft rotates the torque on the camshaft varies periodically between positive torque and negative torque in a sinusoidal manner. The exact period, magnitude and shape of the cam torque variation depends on a number of factors including the number of valves regulated by the camshaft and the engine rotation frequency. Positive cam torque resists cam rotation, while negative cam torque aids cam rotation. Cam torque actuated phasers utilize these periodic torque variations to rotate the rotor in the chosen direction, thereby advancing or retarding the camshaft timing. In principle they operate as "hydraulic ratchets", allowing fluid to flow in a single direction from one chamber to the other chamber due to the torque acting on the oil in the chambers and causing periodic pressure fluctuations. The reverse direction of fluid flow is blocked by check valve. Therefore, the rotor will be rotationally shifted relative to the stator every period the torque acts in the relevant direction, but will remain stationary when the torque periodically acts in the opposite direction. In this manner, the rotor can be rotated relative to the stator, and the timing of the camshaft can be advanced or retarded.

Cam torque actuation systems therefore require check valves to be placed inside the rotor in order to achieve the "hydraulic ratchet" effect. The directing of oil flow to the advance chamber, retard chamber, or both/neither (in a holding position) is typically achieved using a three-positional spool valve. This spool valve can be positioned either centrally, i.e. co-axially with the camshaft, or remotely, i.e. as a non-rotating component of the cam phasing arrangement. The three-positional spool valve is typically moved to each of the three operative positions using a variable force solenoid.

Patent application US 2008/0135004 describes a phaser including a housing, a rotor, a phaser control valve (spool) and a regulated pressure control system (RCPS). The phaser may be a cam torque actuated phaser or an oil pressure activated phaser. The RPCS has a controller which provides a set point, a desired angle and a signal based on engine parameters to a direct control pressure regulator valve. The direct control pressure regulator valve regulates a supply pressure to a control pressure. The control pressure moves the phaser control spool to one of three positions, advance, retard and null, in proportion to the pressure supplied.

Despite prior art solutions for cam timing phasers, there remains a need for improved cam timing phaser arrangements. In particular, there remains a need for cam timing phaser arrangements that are suitable for use commercial vehicles, which are often subject to heavier engine loads and longer service lives as compared to passenger cars.

SUMMARY OF THE INVENTION

The inventors of the present invention have identified a range of shortcomings in the prior art, especially in relation to the use of existing cam phaser arrangements in commercial vehicles. It has been found that the three-positional spool valves of the oil control valve (OCV) in present systems must be precisely regulated and therefore are sensitive to impurities that may jam the spool in a single position. Due to the need for three-position regulation, the solenoids or pressure regulators used in conjunction with the oil control valve must be able to be precisely regulated to provide varying force, in order to attain three positions. This adds considerable mechanical complexity to the system, making it more expensive, more sensitive to impurities and less robust. It also makes the routines for controlling the cam phaser more complex.

It has been observed that that when the oil control valve is solenoid-actuated and centrally mounted, the contact between the solenoid-pin and the oil control valve is non-stationary since the oil control valve rotates and the solenoid-pin is stationary. This sliding-contact wears the contact surfaces and the position accuracy of the oil control valve is compromised over the long-term which affects the cam phaser performance. The accuracy of the variable force solenoid itself must also remain high to ensure precise control over the OCV.

Further, oil leakage of existing cam phaser arrangements is also a problem. Cross-port leakage inside the oil control valve cause oil to escape the hydraulic circuit and increase camshaft oscillations due to decreased system stiffness. This leakage also affects the oil consumption of the cam phaser arrangement. It has been observed that the three-positional spool valves used in regulating oil flow offer many different leakage paths for oil to escape the cam phaser chambers. Most noticeable is the sliding contact surface closest to the variable force solenoid where the valve is solenoid-actuated, as well as the port connected to vent. This leakage increases with increased pressure inside the cam phaser chambers since all the pressure spikes in the system must be absorbed by the oil control valve. These pressure spikes are in turn dependent on camshaft torque and may exceed 50 bars for commercial vehicles. Camshaft torques are higher in heavy-duty vehicles, causing higher pressure spikes and even more leakage.

It has been observed that existing cam phasing systems utilizing remotely-mounted oil control valves suffer from even greater system leakage because the pressure spikes from the cam phaser must be transmitted through the camshaft journal bearing before reaching the oil control valve, therefore increasing bearing leakage.

Further, it has been found that the rotor of existing cam torque actuated phasing systems is very compact and complex. Specially-designed check valves must be mounted in the rotor in order to fit in conjunction with the oil control valve. Such check valves are less durable than conventional check valves and add additional expense. Moreover, the rotor requires a complex internal hydraulic pipe system. Due to these requirements, the manufacturing of cam torque actuated cam phasers requires special tools and assembling.

It is seen that solenoid-actuated centrally-mounted oil control valves require additional axial space on top of the engine to be installed, due to the need to accommodate the stationary, centrally-mounted variable force solenoid.

Thus, it is an object of the present invention to provide a variable cam timing phaser arrangement utilizing cam torque actuation that is mechanically simpler, more robust and less prone to oil leakage than known cam torque actuated cam phasers.

This object is achieved by the variable cam timing phaser arrangement according to the appended claims.

The variable cam timing phaser arrangement comprises:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force;

wherein the at least one vane divides the at least one recess into an first chamber and a second chamber, the first chamber and the second chamber being arranged to receive hydraulic fluid under pressure wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa.

The control assembly comprises:

an on/off piloted valve located centrally within the rotor or camshaft, the piloted valve comprising a pilot port, a first flow port and a second flow port, the first flow port being in fluid communication with the first chamber and the second flow port being in fluid communication with the second chamber, wherein the piloted valve is switchable between an open state and a closed state by regulation of the pressure of a pilot fluid at the pilot port, wherein in the open state the piloted valve allows fluid communication between the first chamber and second chamber, and in the closed state the piloted valve prevents fluid communication between the first chamber and the second chamber; and a solenoid-controlled actuator located remotely from the rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port.

The variable cam timing phaser arrangement described can be used to provide cam phasing by timing the opening and closing of the valves to allow directional fluid flow from one of the chambers to the other, in the desired direction, while preventing flow in the opposite undesired direction.

A variable cam timing phaser arrangement constructed in this manner has a number of advantages. It is constructionally simple and requires only simple on/off valves and/or solenoids to control the cam phaser. Sliding wear between the piloted valve and the solenoid actuator can be avoided since the piloted valve is actuated remotely without physical contact. The cam phaser is more robust due to less complex and/or less sensitive hydraulic components compared to other cam torque actuated cam phasers. The use of constructionally robust on/off valves and the avoidance of transferral of pressure spikes through the camshaft bearings mean that oil escape paths are fewer and oil consumption lower. The risk of valves jamming is lowered since any valves used need to take only two positions meaning that a greater actuating force and/or stronger return mechanisms can be used. More robust solenoids can be used since intermediate position accuracy is not needed. Similarly, no fine multi-pressure regulation is needed to actuate the on/off piloted valve. Check-valves can be mounted externally to the cam phaser (i.e. not in the rotor or stator), thus allowing the use of more established and robust check valves. Further advantages are that the rotor component bears a greater similarity to oil-actuated cam phasers which are cheaper to manufacture than known cam torque actuated cam phasers. Engine space, which is at a premium, is saved by the construction in a number of ways. The large multi-positional valve of known CTA cam phasers is replaced by a smaller on/off valve. The centrally-mounted variable force solenoid used in known CTA solutions is replaced by a remote on/off solenoid actuator, which can be placed more freely, making the entire sub-assembly more compact.

The variable cam timing phaser arrangement may utilize hydraulic oil as the hydraulic fluid and/or pilot fluid. Cam phasers utilizing hydraulic oil are well established. By utilizing hydraulic oil as the pilot fluid, the construction of the cam phaser arrangement is simplified and alternative routes for refilling the cam phaser with oil are made available.

The variable cam timing phaser arrangement may utilize air as the pilot fluid. Thus, the on/off piloted valve may be pneumatically actuated. Pneumatically actuated hydraulic valves are well established, robust components, well suited to prolonged use.

The piloted valve may be a 2/2 way on/off valve, arranged to be normally in the open state, and actuated by increased fluid pressure at the pilot port to switch to the closed state. Such valves are readily-available, well-established and sufficiently robust to provide reliable service in commercial and heavy vehicle applications.

The solenoid-controlled actuator may be a 3/2 way on/off solenoid valve having an inlet port in fluid communication with a source of increased fluid pressure, an outlet port in fluid communication with the pilot port of the piloted valve, and a vent port, wherein the primary state of the solenoid valve is a de-energized state preventing fluid communication from the source of increased fluid pressure to the pilot port of the piloted valve and allowing fluid communication from the pilot port of the piloted valve to the vent port, and wherein the secondary state of the solenoid valve is an energized state allowing fluid communication from the source of increased fluid pressure to the pilot port of the piloted valve. This increased fluid pressure may be used to actuate the piloted valve. Such solenoid valves are readily-available, well-established and sufficiently robust to provide reliable service in commercial and heavy vehicle applications. The solenoid valve may be of the poppet-type, which virtually eliminates the risk for valve jam.

The solenoid-controlled actuator may comprise a solenoid-driven piston arranged in a cylinder, the cylinder being arranged in fluid communication with the pilot port of the piloted valve, wherein the primary state of the solenoid-driven piston is a retracted de-energized state and the secondary state of the solenoid-driven piston is an extended energized state, the extended state increasing the pressure of the fluid at the pilot port of the piloted valve. This increased fluid pressure may be used to actuate the piloted valve. Thus the actuation pressure of the piloted valve need not be dependent on the system oil pressure of the vehicle. Utilizing a cylinder actuator, the actuation pressure can be designed to be higher than the oil system pressure, or lower, if desired. This allows for greater system robustness.

The piloted valve may be a 2/2 way on/off valve, arranged to be normally in the closed state, and actuated by decreased fluid pressure at the pilot port to switch to the open state. Such valves are again readily-available, well-established and sufficiently robust to provide reliable service in commercial and heavy vehicle applications. From a failsafe perspective, it may be desirable to have a piloted valve that is normally closed and therefore holds phase angle when not actuated.

The solenoid-controlled actuator may comprise a solenoid-driven piston arranged in a cylinder, the cylinder being arranged in fluid communication with the pilot port of the piloted valve, wherein the primary state of the solenoid-driven piston is an retracted energized state and the secondary state of the solenoid-driven piston is an extended de-energized state, the retracted state decreasing the pressure of the fluid at the pilot port of the piloted valve. This decreased fluid pressure may be used to actuate the piloted valve by a "pulling" effect. The use of such a cylinder in combination with the normally closed piloted valve described above means that the piloted valve will close if the solenoid actuator is deactivated or malfunctions, meaning that the cam phaser will hold the phase angle in such a case.

The solenoid-controlled actuator described above may further comprises a normally open 2/2 way solenoid valve having an inlet port in fluid communication with a source of increased fluid pressure and an outlet port in fluid communication with the cylinder, wherein the primary state of the solenoid valve is a closed energized state and the secondary state of the solenoid valve is an open de-energized state, allowing fluid communication from the source of increased fluid pressure to the pilot port of the piloted valve. This ensures sufficient pressure at the pilot port to return the piloted valve to the de-actuated position without the need for a spring return mechanism. Spring return mechanisms may instead be placed on the solenoids or the solenoid actuator. Since these are located remotely from the rotating components of the cam phaser, larger, more robust springs may be used.

A source of increased fluid pressure may be arranged in fluid communication with the first chamber and the second chamber via a first refill channel and a second refill channel respectively, the first refill channel and second refill channel each having a check valve arranged to prevent fluid flow from the first chamber or second chamber to the source of increased fluid pressure. This ensures that the cam phaser is sufficiently supplied with oil for optimal performance.

The variable cam timing phaser arrangement may comprise a pilot check valve having a first flow port arranged in fluid communication with the piloted valve, a second flow port arranged in fluid communication with the second chamber and a pilot port arranged in fluid communication with the second refill channel wherein the pilot check valve is arranged to be in a first state allowing flow between the piloted valve and the second chamber in any direction when the fluid pressure in the second refill channel is greater than a predetermined pressure, and to be in a second state when the fluid pressure in the second refill channel is lower than the predetermined pressure, wherein when in the second state the pilot check valve allows fluid flow only from the second chamber via the piloted valve to the first chamber, and prevents flow from the first chamber to the second chamber. Such a pilot check valve acts as a "hydraulic ratchet" in the event of oil system failure and moves the rotor by camshaft toque actuation towards a chosen locking position (either fully advanced or fully retarded). Thus, the need for a torsional spring failsafe mechanism that biases the cam phaser towards the locking position can be avoided. This means that more torque can instead be harvested for moving the rotor when performing cam phasing.

According to another aspect of the invention, a method for controlling the timing of a camshaft in an internal combustion engine comprising a variable cam timing phaser arrangement as described above is provided. The method comprises the steps:

i. Providing the solenoid-controlled actuator in a secondary state, thereby providing the piloted valve in a closed state, thus preventing fluid communication between the first chamber and the second chamber;

ii. Timing the switching the solenoid-controlled actuator from the secondary state to the primary state to coincide with a camshaft torque acting in a chosen direction, thereby switching the piloted valve to the open state and allowing fluid to flow between the first chamber and the second chamber in a direction in accordance with the chosen direction of camshaft torque, thus rotating the rotor relative to the stator in a chosen direction;

iii. Switching the solenoid-controlled actuator from the primary state to the secondary state prior to the direction of camshaft torque changing, thereby switching the piloted valve to the closed state and preventing fluid flowing between the first chamber and the second chamber in an opposite direction to that of step ii.

iv. Repeating steps ii and iii until a desired angle of the rotor relative to the stator is obtained; and v. Maintaining the solenoid-controlled actuator in a secondary state, thereby providing the piloted valve in a closed state, thus preventing fluid communication between the first chamber and the second chamber, and thereby maintaining the desired angle of the rotor relative to the stator.

This method provides a simple, reliable way of controlling cam phasing. Since the camshaft torque fluctuates in a periodic known manner depending on engine conditions and the number of valves that the camshaft services, no complicated sensors are required to provide the desired timing: the means for timing are already present in the timing arrangement, i.e. cam sprocket and timing belt/chain of present vehicles.

The switching of the solenoid-controlled activator in step ii. may be timed to coincide with the camshaft torque increasing over a threshold value and the switching of the solenoid-controlled activator in step iii. may be timed to coincide with the camshaft torque decreasing under a threshold value. A certain threshold pressure difference may be needed between both chambers in order to initiate and maintain rotation of the rotor. The threshold for initiation and maintenance of rotation may or may not be the same. By controlling the timing of the switching in the manner described above it can be ensured that the piloted vale is only opened when rotation is attainable.

According to a further aspect, an internal combustion engine comprising a variable cam timing phaser arrangement as described above is provided.

According to yet another aspect, a vehicle comprising a variable cam timing phaser arrangement as described above is provided.

Further aspects, objects and advantages are defined in the detailed description below with reference to the appended drawings.

BRIEF DESCRIPTION OF THE DRAWINGS

For the understanding of the present invention and further objects and advantages of it, the detailed description set out below can be read together with the accompanying drawings, in which the same reference notations denote similar items in the various diagrams, and in which.

DETAILED DESCRIPTION OF THE INVENTION

Figure 1:
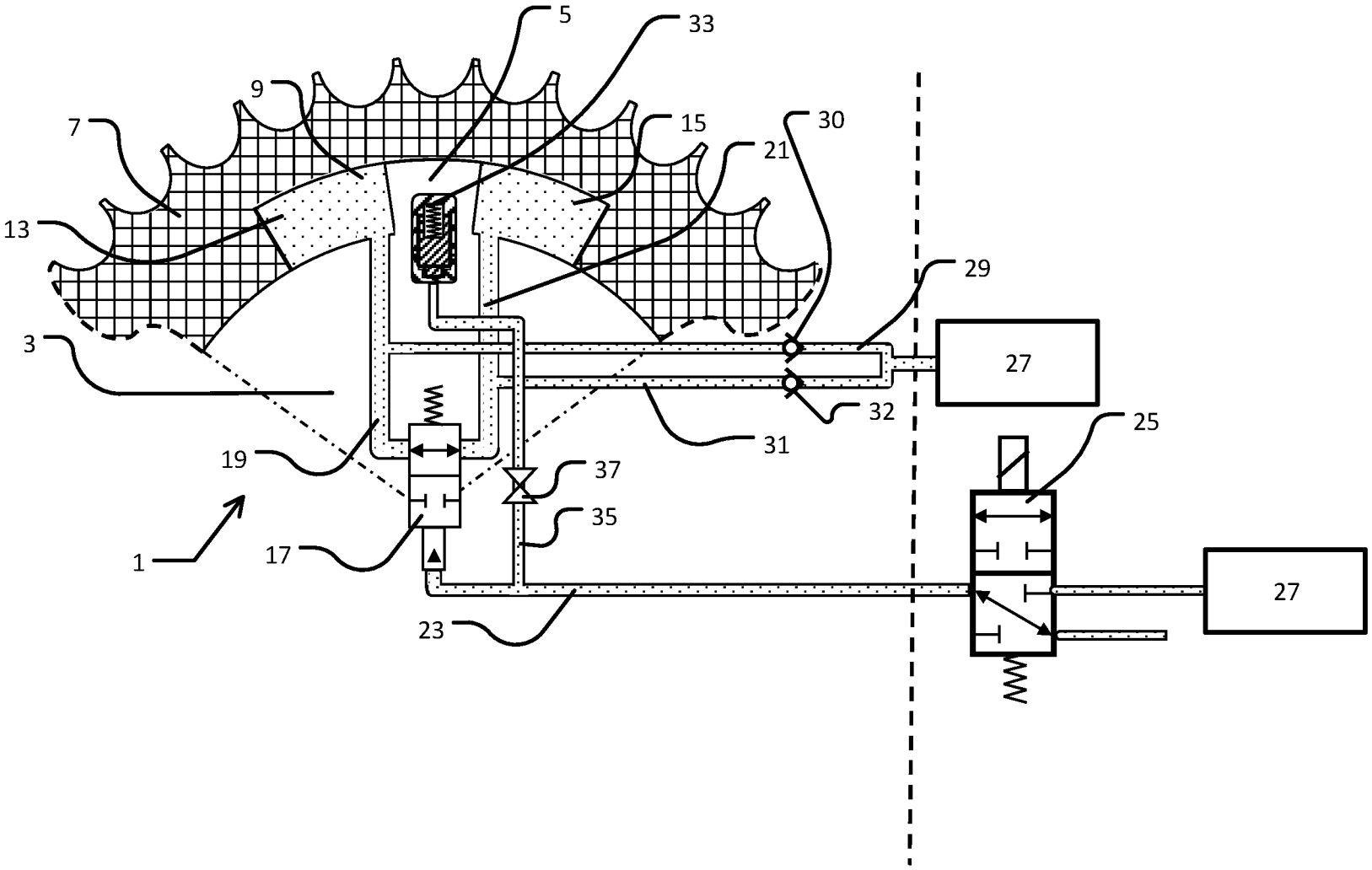
FIG. 1 illustrates schematically one embodiment of a variable cam timing phaser arrangement according to the present disclosure.

The present invention is based on the realization that cam torque actuated cam phasing can be achieved by utilizing a centrally-mounted on/off piloted valve instead of the multi-positional spool valve known in the prior art. The on/off valve controls fluid passage between a first chamber of the cam phaser and a second chamber. The switching of the piloted valve can be timed to allow flow during each period the camshaft torque acts in the desired direction and to prevent flow when the camshaft torque acts in the opposite direction. In this manner, the rotor is shifted rotationally in in the desired direction relative to the stator.

The cam timing phaser arrangement of the present invention comprises a rotor, a stator co-axially surrounding the rotor, and a control assembly.

The cam phaser rotor is arranged to be connected to a camshaft of the internal combustion engine. This can be an intake valve camshaft, exhaust valve camshaft, or any other camshaft in the engine such as a combined intake/exhaust camshaft. The rotor has at least one vane, but may preferably have a plurality of vanes, such as three, four, five or six vanes. Separate oil channels for channelling oil to and from the piloted valve of the control assembly are provided at each side of at least one of the vanes, but preferably at each side of each of the vanes.

The stator is arranged for accepting drive force. This may for example be by connecting the stator to a cam sprocket, which takes up drive force from the crankshaft via the timing belt. The stator may also be constructionally integrated with the cam sprocket. The stator co-axially surrounds the rotor and has at least one recess for accepting the at least one vane of the rotor. In practice, the stator has the same number of recesses as the number of rotor vanes. The recesses in the stator are somewhat larger than the rotor vanes, meaning that when the rotor is positioned in the stator with the vanes centrally positioned in the recesses, a chamber is formed at each side of each rotor. These chambers can be characterized as first chambers, rotating the rotor in a first direction relative to the stator when filled with hydraulic oil, and second chambers, rotating the rotor in a second direction relative to the stator when filled with hydraulic oil.

The control assembly comprises a piloted valve and a remotely-located solenoid-controlled actuator for actuating the piloted valve.

Where valves are referred to as "on/off" this refers to a valve having only two states: an open state and a closed state. Such valves may however have more than two ports. For example, a 3/2 way on/off valve has three ports and two states. Such a valve often connects two flow ports when open and connects one of the flow ports to a vent/exhaust port when closed.

Where valves are referred to as "normally closed/open/on/off", this refers to the state of the valve when non-actuated. For example, a normally open solenoid valve is held in the open position when not actuated/energized, commonly using a return such as a spring return. When the normally open solenoid valve is actuated/energized the solenoid acts with a force sufficient to overcome the force of the return holding the valve open, and the valve is therefore closed. Upon de-actuation/de-energization, the return returns the valve to the open state.

Where components are stated to be in "fluid communication" or flow is allowed or prevented "between" components, this flow is to be interpreted as not necessarily directional, i.e. flow may proceed in either direction. Directional flow in a single direction is denoted as flow "from" a component "to" another component.

The piloted valve may be a 2/2 way on/off valve, i.e. a valve having two flow ports, i.e. a first and second port, and two positions (open or closed). The piloted valve is in fluid communication with the oil channels leading to the first chambers at the first port and is in fluid communication with the oil channels leading to the second chambers at the second port. Therefore, fluid communication between the first and second chambers is established when the valve is open. The pilot valve also has a pilot port connected to the pilot fluid feed. The switching of the on/off piloted valve is regulated by the pressure of the pilot fluid at the pilot port; the pressure of the pilot fluid being regulated by a remotely-placed solenoid actuator. The pilot fluid may be air, i.e. the piloted valve may be pneumatically actuated. However, it is preferable that the pilot fluid is hydraulic oil since this considerably simplifies the system design, due to hydraulic oil already being used in the cam phaser arrangement. The pilot valve may be normally closed, i.e. be closed when non-actuated. However it may also be normally open, i.e. open and allowing fluid communication between the first chamber and the second chamber when non-actuated. The piloted valve may be any suitable valve type known in the art, including but not limited to a poppet valve, sliding spool valve and rotary spool valve. The valve may have a return spring. The piloted valve is located centrally, such as in the rotor or camshaft.

The solenoid actuator is located remotely from the rotating components of the cam phaser arrangement and may instead placed on a stationary component of the internal combustion engine such as the cam bearing holder. The solenoid actuator regulates the pilot fluid pressure in order to actuate the piloted valve. This may be done by increasing the pressure to actuate the piloted valve by "pushing". However the piloted valve may also be actuated by a "pulling" effect using decrease pilot fluid pressure. The solenoid actuator may be an on/off solenoid valve that increases fluid pressure by connection to a source of fluid pressure, such as the main oil gallery if oil is used as the pilot fluid. It can, for example be a 3-port, 2-position on/off solenoid valve being connected to an oil gallery at the inlet port, at the outlet port being connected to an oil channel leading to the pilot port of the pilot valve, and having a vent port for release of oil pressure from the channel leading to the pilot port when in the "off" position. It may normally be in the "off" position when the solenoid is not actuated, and switch to the "on" position upon activation of the solenoid. The solenoid valve may be any suitable valve type known in the art, including but not limited to a poppet valve, sliding spool valve and rotary spool valve. The use of a poppet valve virtually eliminates the risk for valve jam.

The solenoid actuator may also be an oil-filled cylinder in fluid connection with the pilot port of the piloted valve. An on/off solenoid-actuated piston is provided in the cylinder. The solenoid-actuated piston may push down on the volume of oil in the cylinder upon actuation, leading to increased pressure at the pilot port. Alternatively, the solenoid-actuated piston may retract in the cylinder upon actuation, leading to decreased oil pressure at the pilot valve, and therefore a "pull" effect.

The oil pressure may be maintained in the cam phaser system by connection to a source of oil pressure, such as the main oil gallery. For example, such connection points may be arranged on the fluid channels leading from the first and/or second chambers to the piloted valve. Such connection points may also be arranged in conjunction with the solenoid actuator, for example as a connection to the inlet port of a solenoid valve (as previously mentioned), or in conjunction with an oil-filled cylinder. The channel(s) connecting to the source of oil pressure may be provided with a check valve(s) to prevent backflow of oil from the cam phaser assembly to the source of oil pressure.

The cam phaser assembly may also be provided with a number of failsafe features. For example, a pressure-actuated lock pin may be arranged in at least one of the vanes of the rotor, together with a corresponding recess in the stator for receiving the lock pin. The recess for receiving the locking pin is located at a base position, i.e. either fully advanced or fully retarded. A torsion spring may be provided in order to bias the rotor towards the base position in the event of system failure. The lock pin is normally in the deployed (locking) position, and is actuated to the retracted (unlocked) position when the pressure in a component of the cam phaser arrangement exceeds a threshold pressure. For example, the lock pin may be in fluid connection with one or more channels leading from a chamber to the piloted valve. The lock pin may alternatively be in fluid connection with a channel leading from the solenoid actuator to the piloted valve. This means that the lock pin may deploy in the event of solenoid failure. In such a case, a constriction may be provided in the channel leading to the lock pin so that transitory dips in oil pressure at the pilot port when performing cam phasing do not lead to the lock pin deploying momentarily.

Another failsafe feature that can be utilized is a pilot check valve arranged in a channel leading from a chamber to the piloted valve. This pilot check valve is normally allows flow in either direction whenever the pressure in the channel exceeds a threshold level. However, if the pressure in the channel is reduced below the threshold level, e.g. in the event of system failure, the pilot check valve prevents flow in one direction. This results in a "hydraulic ratchet" effect being achieved, provided that the piloted valve is open, and the rotor is directed towards locking base position by the action of the camshaft torque. Thus, by using such a pilot check valve failsafe measure, the need for a failsafe torsional spring in the rotor is removed, thus allowing the cam phaser to utilize more of the camshaft torque.

When camshaft phasing is desired, the switching of the solenoid actuator is timed so that the piloted valve is opened to coincide with camshaft torque in the desired direction and the piloted valve is closed to coincide with camshaft torque in the direction opposite to the desired direction. So, for example positive camshaft torque resists cam rotation and retards the variable cam timing. If retardation of the camshaft timing is desired, actuation of the solenoid actuator is timed so that the piloted valve is open during periods of positive torque and closed during periods of negative torque. Likewise, if advancement of the camshaft timing is desired, actuation of the solenoid actuator is timed so that the piloted valve is open during periods of negative torque and closed during periods of positive torque. The switching of the solenoid actuator may also be controlled so that the piloted valve is open only when the torque exceeds a certain (positive or negative) magnitude.

The invention will now be further illustrated with reference to the figures.

FIG. 1 shows a one embodiment of the variable cam timing phaser arrangement 1 of the invention. A rotor 3 comprises at least one vane 5. A stator 7 having at least one recess 9 co-axially surrounds the rotor 3. The stator is fixed to a cam sprocket (not shown). The vane 5 divides the recess 9 into a first chamber 13 and a second chamber 15. A 2/2 way on/off piloted valve 17 is arranged centrally in the rotor 3. A first oil channel 19 is arranged at the side of the vane 5 and leads from the first chamber 13 to a first port of the piloted valve 17. A second oil channel 21 is arranged at the side of the vane 5 and leads from the second chamber 15 to a second port of the piloted valve 17. A pilot oil channel 23 leads from the pilot port of the pilot valve 17 to an outlet port of a 3/2 way on/off solenoid valve 25. The solenoid valve 25 is located on a stationary component of the internal combustion engine such as the cam holder bearing, remote from the rotating components of the combustion engine such as the rotor 3, stator 7, cam sprocket and camshaft (not shown). The inlet port of the solenoid valve 25 is connected to a source of oil pressure 27, and the remaining port of the solenoid valve 25 is a vent port. Oil refill channels 29, 31 leading from a source of oil pressure 27 adjoin the first oil channel 19 and second oil channel 21 respectively. Each of the oil refill channels 29, 31 is fitted with a check valve (30, 32) preventing oil backflow from the first and second oil channels 19, 21. A lock-pin 33 is arranged in the vane 5 of the rotor 3. The lock-pin 33 is in fluid communication with the pilot oil channel 23 though a lock oil channel 35. A restricting orifice 37 is arranged in the lock oil channel 35.

The piloted valve 17 is open when not actuated by increased fluid pressure and the solenoid valve 25 is closed (leads the pilot oil channel 23 to vent) when not actuated. To set the cam timing phaser arrangement 1 in a holding state, i.e. a state where no phasing takes place, the piloted valve 17 must be closed by actuating the solenoid valve 25 to increase the oil pressure in the pilot oil channel 23. Once in the holding state, the cam timing phaser arrangement 1 can be advanced by timing the switching of the solenoid valve 27 so that the piloted valve 17 is open to coincide with periods of negative torque on the camshaft and closed to coincide with periods of positive torque. Alternatively, the cam timing phaser arrangement 1 can be retarded by timing the switching of the solenoid valve 27 so that the piloted valve 17 is open to coincide with periods of positive torque on the camshaft and closed to coincide with periods of negative torque. When the desired degree of timing advancement or retardation is obtained, the phasing can be held (maintained) by actuating the solenoid valve 25.

Oil refill channels 29, 31 ensure a constant supply of oil to the cam phaser arrangement 1. The lock pin 33 is retracted (unlocked) when the solenoid valve 25 provides oil pressure to the pilot oil channel 23, which it must do in order to hold phasing. During phasing the pressure will fluctuate in the pilot oil channel 23, but due to the high frequency of the switching and the restricting orifice 37, the lock pin 33 will not experience these pressure fluctuations and will not deploy. However, if the oil system pressure becomes too low or the solenoid is deactivated for a significant period of time, the lock pin 33 will deploy and the rotor will be rotated to base (locking) position by a torsional spring (not shown).

Figure 2:
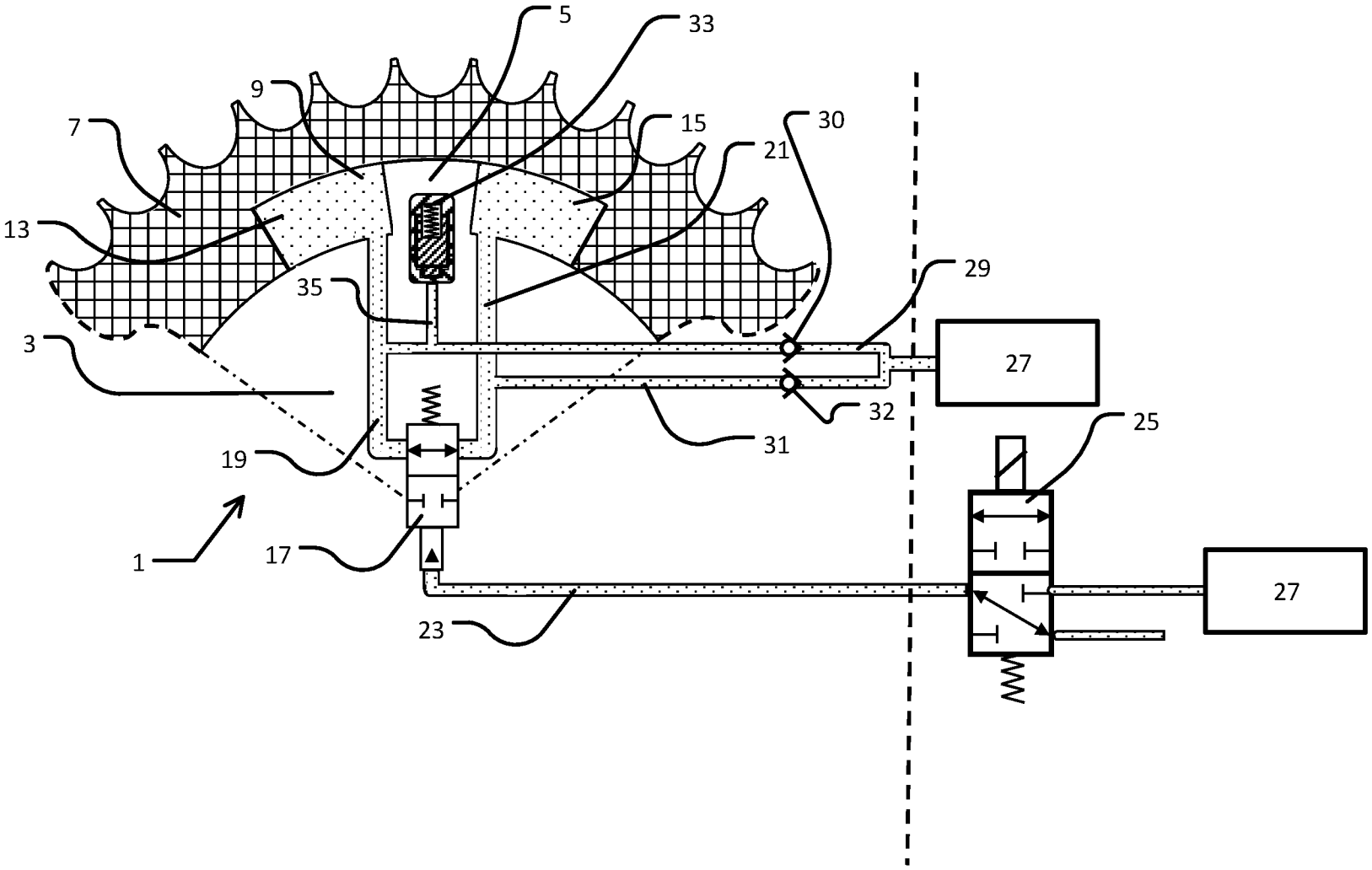
FIG. 2 illustrates schematically another embodiment of a variable cam timing phaser arrangement according to the present disclosure.

The embodiment shown in FIG. 2 is similar to that of FIG. 1 except that the lock oil channel 35 is in fluid communication with the oil refill channel 29 instead of the pilot oil channel 23. In this embodiment, the lock-pin will be retracted when the system pressure is sufficiently high and will deploy when the system pressure sinks below a threshold level, irrespective of the functioning of the solenoid valve.

Figure 3:
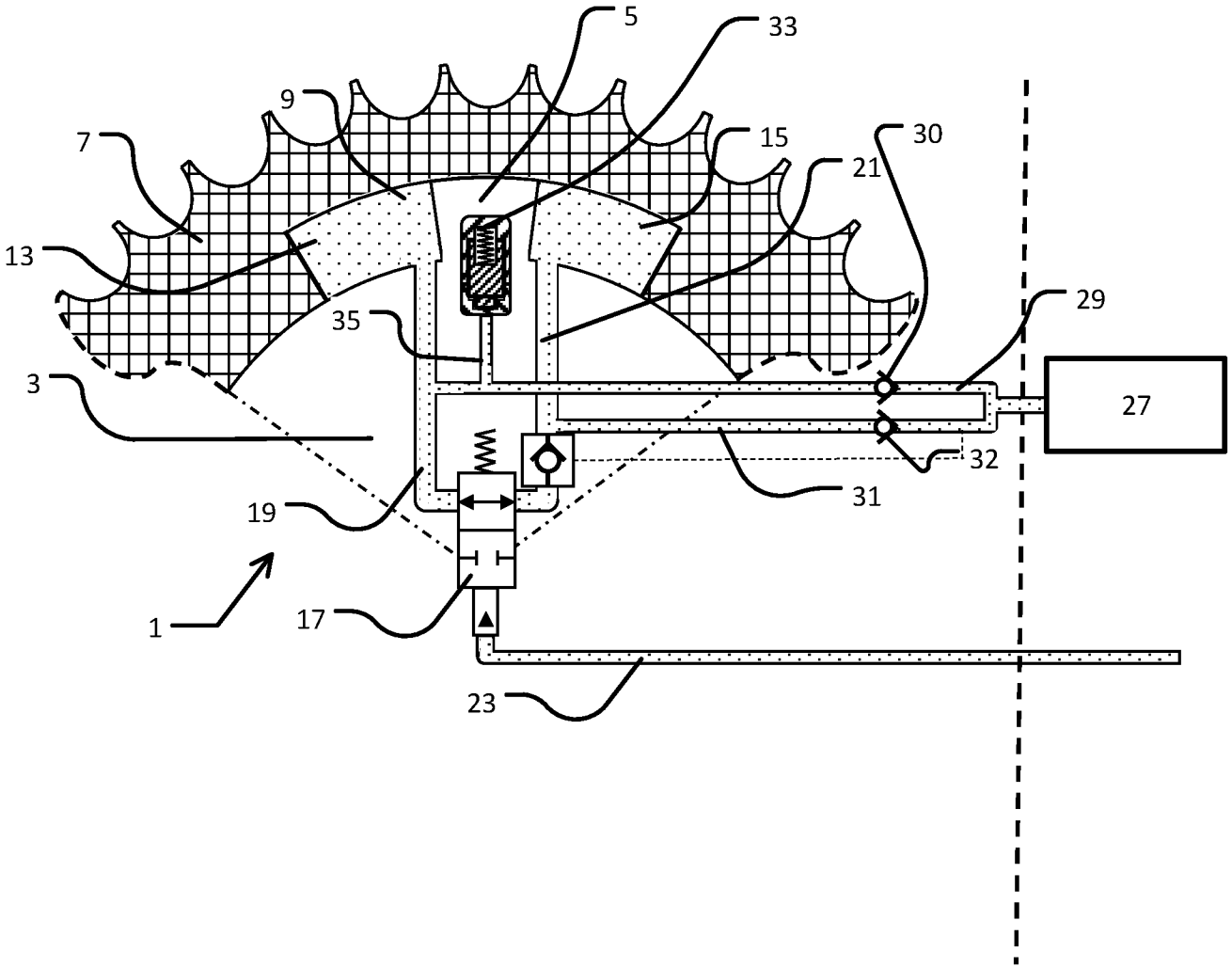
FIG. 3 illustrates schematically yet another embodiment of a variable cam timing phaser arrangement according to the present disclosure.

The embodiment shown in FIG. 3 is similar to that of FIG. 2 except that a pilot check valve 39 is arranged in the second oil channel 21 in proximity to the piloted valve 17. If the system oil pressure is above a threshold level the pilot check valve 39 will allow oil flow in both directions. However, if the pressure falls below this threshold, the pilot check valve 39 will allow only flow from the second chamber 15 to the first chamber 13. This means that upon failure of the oil system, the rotor will move to base (locking) position by cam torque actuation, without the need for a torsional spring. The pilot check valve may instead be arranged in the first oil channel 19 if the locking position at the opposite rotational extremity is desired.

Figure 4:
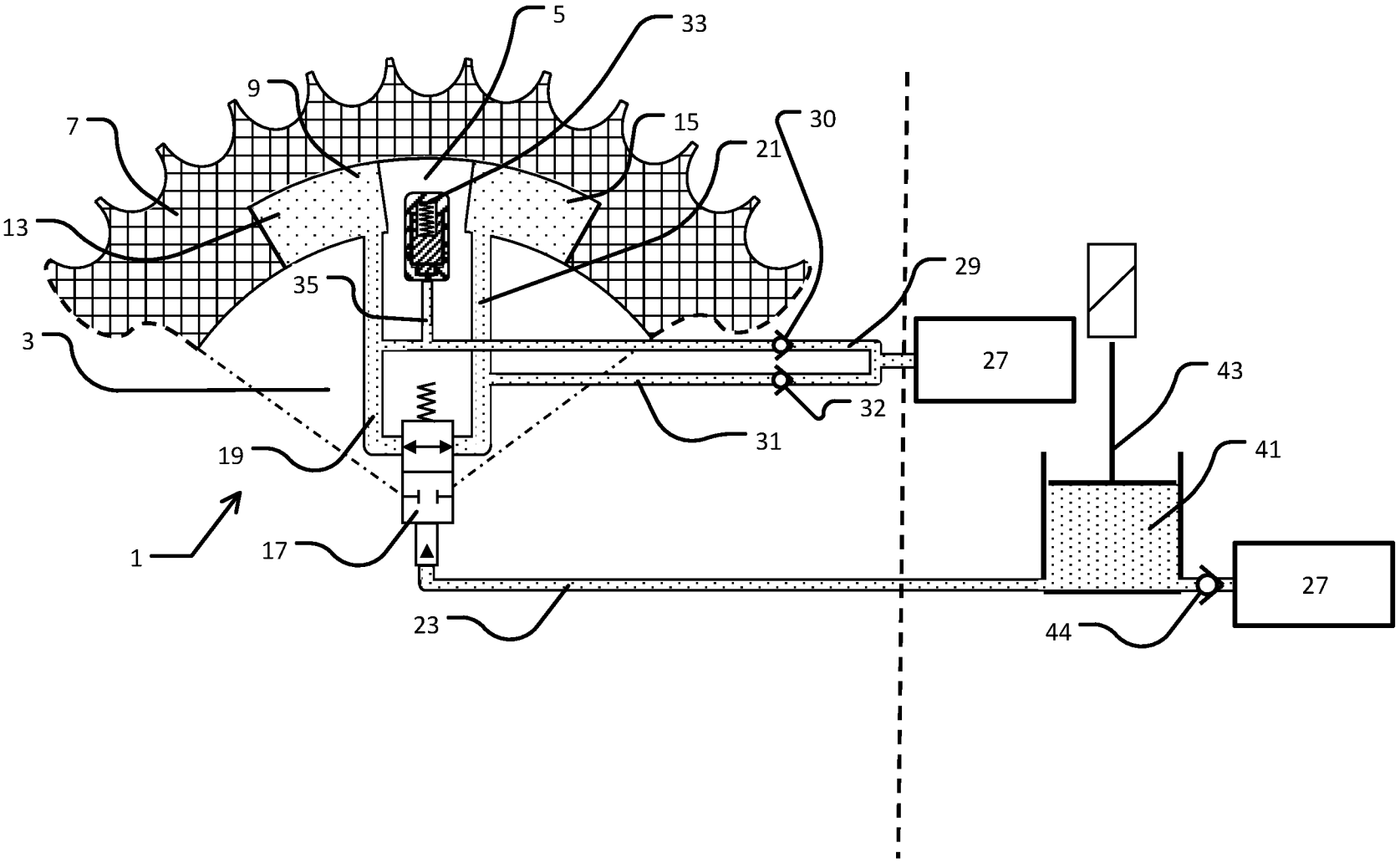
FIG. 4 illustrates schematically a further embodiment of a variable cam timing phaser arrangement according to the present disclosure.

The embodiment shown in FIG. 4 is similar to that of FIG. 2, except that a cylinder 41 with solenoid-actuated piston 43 replaces the solenoid valve 25 as the solenoid actuator. The source of oil system pressure 27 is coupled to the pilot oil channel 23 by a check valve 44 to prevent backflow. Pressure is increased at the pilot port of the piloted valve 17 by actuating the solenoid-actuated piston 43, whereby it presses down upon the column of oil in the cylinder, thereby raising pressure in the cylinder 41 and pilot oil channel 23 in fluid communication with the cylinder 41.

Figure 5:
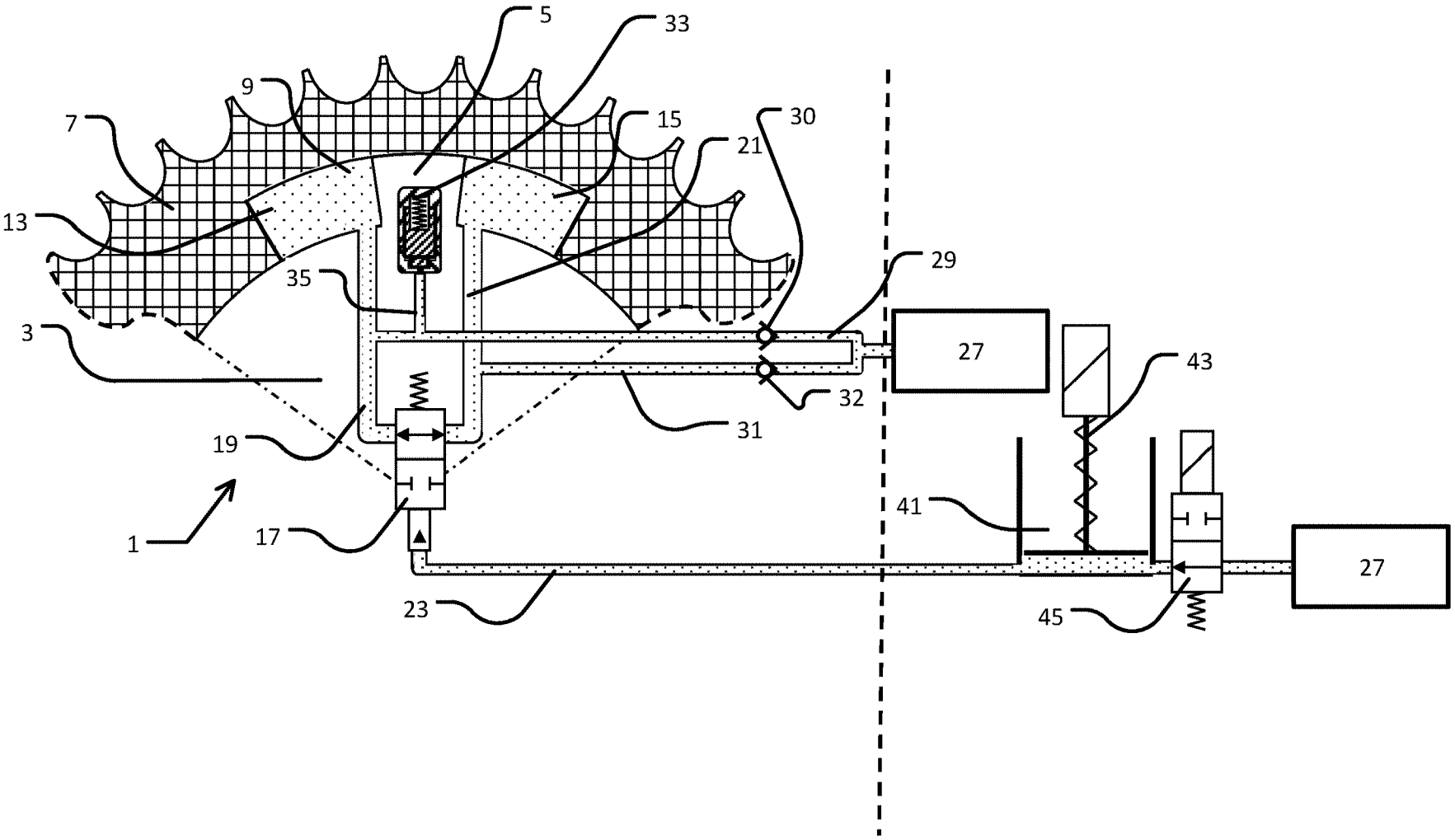
FIG. 5 illustrates schematically yet a further embodiment of a variable cam timing phaser arrangement according to the present disclosure.

The embodiment shown in FIG. 5 is similar to that of FIG. 2 but utilizes a different control assembly. The cam phaser arrangement is shown with no system oil pressure and therefore the piloted valve 17 is open. During operation at normal system pressure, the piloted valve 17 is a normally closed 2/2 way valve. The piloted valve 17 may then be actuated (opened) by a pressure reduction at the pilot port, i.e. the valve is "pulled" open by reduced oil pressure. The solenoid actuator is a cylinder 41 with a solenoid-actuated piston 43. However, in contrast to the cylinder of the embodiment of FIG. 4, the solenoid-actuated piston 43 is normally in an extended position, pressing down upon the column of fluid in the cylinder 41 due to the presence of a spring return on the solenoid-actuated piston 43. When actuated, the solenoid-actuated piston 43 retracts, reducing the pressure in the cylinder 41 and pilot oil channel 23, thereby "pulling" the piloted valve 17 open. A separate on/off 2/2 way solenoid valve 45 provides a fluid connection from a source of oil pressure 27 to the cylinder 41 and pilot oil channel 23. This solenoid valve 45 is in open when non-actuated, meaning that the pilot oil channel 23 is subject to oil pressure when the solenoid valve 45 is non-actuated.

Solenoid-actuated piston and solenoid valve 45 work in tandem and are switched simultaneously. When both are non-actuated, the pressure in the pilot oil channel is elevated due to the open connection to the source of oil system pressure 27. When both are actuated, fluid communication with the source of oil system pressure 27 is ended and the retraction of the solenoid-actuated piston 43 decreases oil pressure in the pilot oil channel 23, thus actuating the piloted valve 17. In this embodiment, there is a lesser need for a spring return in the piloted valve 17. Instead, the solenoid-actuated piston and solenoid valve 45 are both fitted with spring returns. Since these components are positioned remotely from the rotating cam phaser components, larger, more robust springs may be used, thus increasing the robustness of the cam phaser arrangement.

The embodiment of FIG. 5 is therefore in a holding state when non-actuated. In order to obtain phasing, the solenoid actuator (solenoid valve 27 and solenoid-actuated piston 43) is energized in order to open the piloted valve 17 during periods when the camshaft torque is acting in the desired direction.

Figure 6:
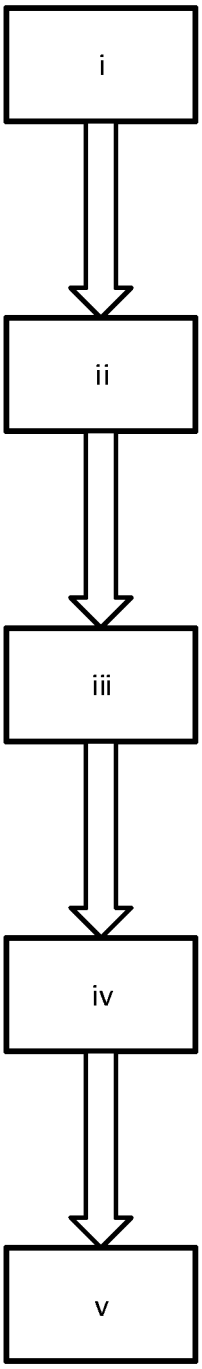
FIG. 6 shows a process chart for a method for controlling the timing of a camshaft in an internal combustion engine according to the present disclosure.

The variable cam timing phaser arrangements described above are used to control the timing of a camshaft in an internal combustion engine. The control method comprises the following steps, as shown in FIG. 6:

The method of controlling the camshaft phasing starts in an initial state whereby the current timing is held. This is achieved when the piloted valve is closed, which in turn is achieved by switching the solenoid actuator to the secondary state, if it is not already in the secondary state. In the holding state, fluid flow between the first chamber and second chamber is not permitted, and therefore rotation of the rotor relative to the stator is not possible.

Figure 7:
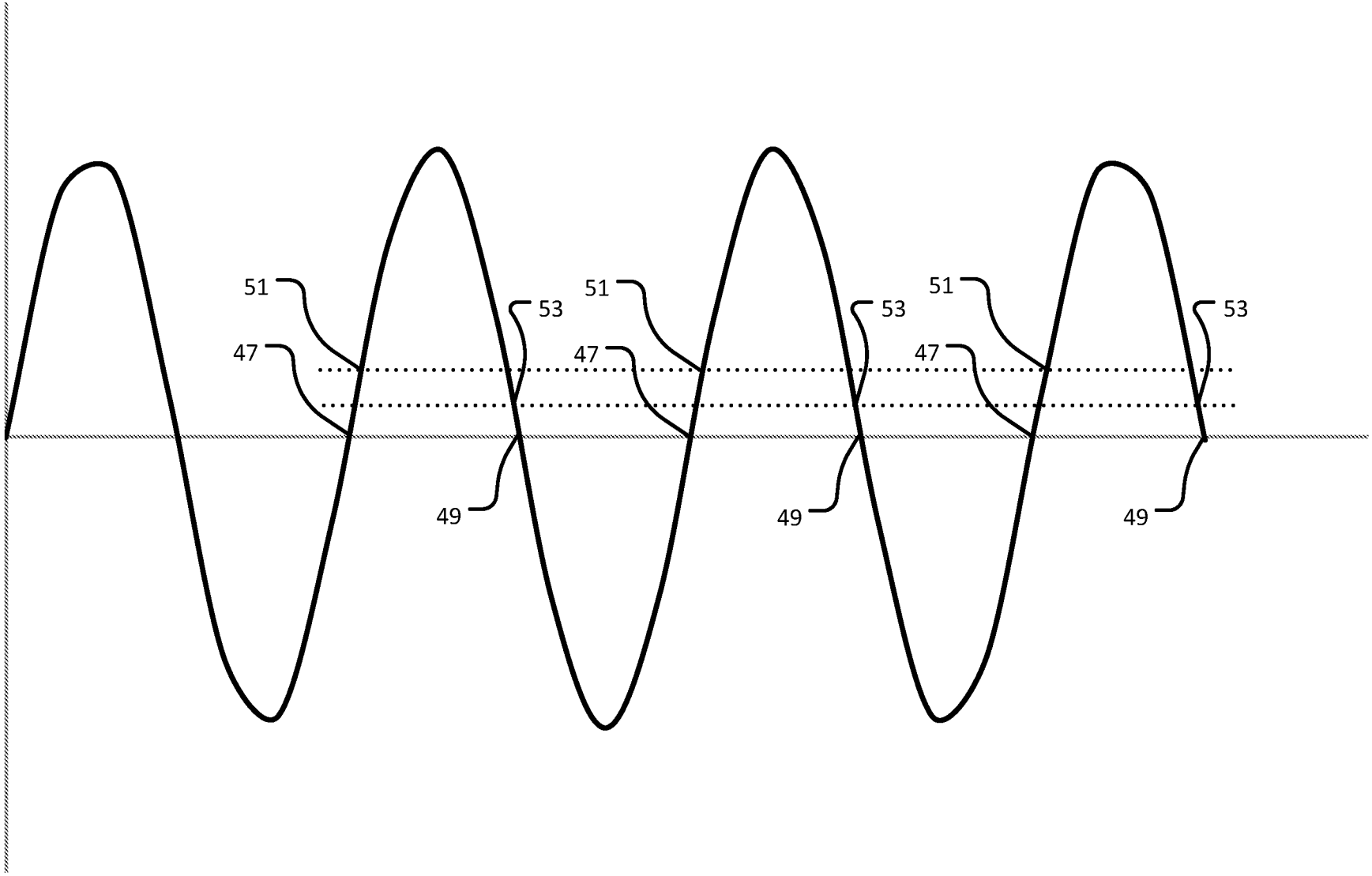
FIG. 7 illustrates schematically the periodic variation in camshaft torque as a function of camshaft angle.

In order to initiate phasing, the piloted valve is opened by switching the solenoid actuator to the primary state. This switching is performed to coincide with the camshaft torque acting in the direction desired for phasing. Positive camshaft torque retards timing and negative camshaft torque advances timing. FIG. 7 shows a schematic representation of how the camshaft torque (y-axis) may vary depending on crank angle (x-axis). For example, in order to achieve retardation of timing, the piloted valve may be opened to coincide with points 47 on the camshaft torque curve.

To obtain a uni-directional flow from one chamber to the other, the piloted valve must be closed when camshaft torque acts in the opposite direction to that desired. This is achieved by switching the solenoid actuator to the secondary state. For example, to achieve timing retardation the piloted valve may be closed to coincide with points 49 on the camshaft torque curve.

Steps ii and iii are repeated until the desired degree of timing advancement or retardation is obtained; i.e. until the desired angle of the rotor relative to the stator is obtained. The rotor is gradually rotated relative to the stator for each time an on/off switching cycle is performed.

One the desired timing has been achieved, the timing is held by maintaining the solenoid actuator in the secondary position.

It should be noted that the solenoid primary state may be a non-actuated state as shown in the embodiments of FIGS. 1-4, or it may be an actuated state as shown in FIG. 5. That is to say that in some embodiments opening of the piloted valve is achieved by energizing the solenoid actuator, and in some embodiments opening of the piloted valve is achieved by de-energizing the solenoid actuator.

There may be barriers to initiating and propagating rotation of the rotor relative to the stator, due to for example frictional effects. Therefore it may in some instances be desirable to open the piloted valve only when the camshaft torque exceeds a value sufficient to initiate rotation and close the piloted valve when the camshaft torque is no longer sufficient to maintain rotation. The torque required for initiation and propagation of rotation may be the same, but are not necessarily the same. For example, in order to achieve retardation of timing, the piloted valve may be opened at points 51 on the camshaft torque curve shown in FIG. 7, and closed at points 53.

Figure 8:
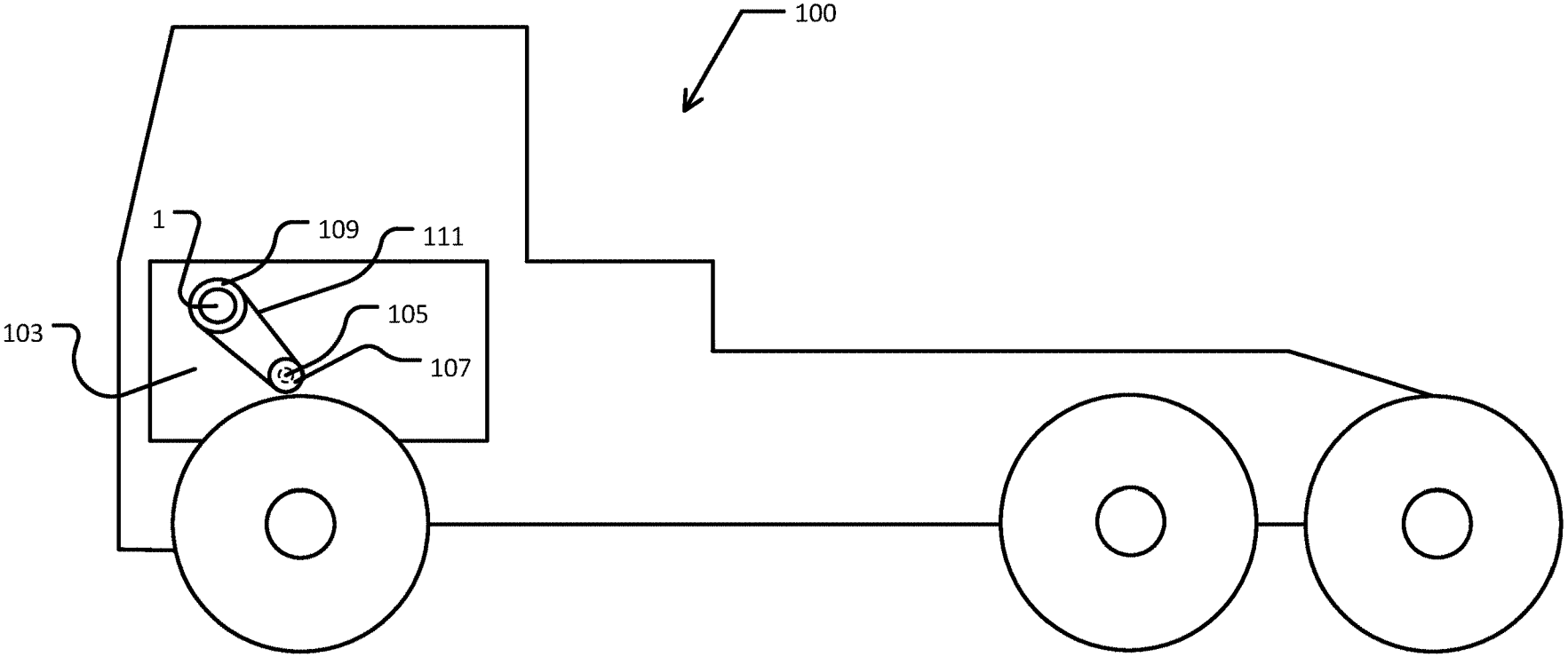
FIG. 8 illustrates schematically a vehicle comprising an internal combustion engine comprising a variable cam timing phaser arrangement according to the present disclosure.

The present invention also relates to an internal combustion engine and a vehicle comprising a variable cam timing phaser arrangement as described above. FIG. 8 shows schematically a heavy goods vehicle 100 having an internal combustion engine 103. The internal combustion engine has a crankshaft 105, crankshaft sprocket 107, camshaft (not shown), camshaft sprocket 109 and timing chain 111. The variable cam timing phaser arrangement 1 is located at the cam sprocket/camshaft. An engine provided with such a variable cam timing phaser arrangement has a number of advantages such as better fuel economy, lower emissions and better performance as compared to a vehicle lacking cam phasing.

The invention claimed is:

1. A variable cam timing phaser arrangement for an internal combustion engine comprising:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force, wherein the at least one vane divides the at least one recess of the stator into a first chamber and a second chamber, the first chamber and the second chamber being arranged to receive hydraulic fluid under pressure wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said control assembly comprising:

an on/off piloted valve located centrally within the rotor or camshaft, the piloted valve comprising a pilot port, a first flow port and a second flow port, the first flow port being in fluid communication with the first chamber and the second flow port being in fluid communication with the second chamber, wherein the piloted valve is switchable between an open state and a closed state by regulation of a pressure of a pilot fluid at the pilot port, wherein in the open state the piloted valve allows fluid communication between the first chamber and second chamber, and in the closed state the piloted valve prevents fluid communication between the first chamber and the second chamber; and a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port, i. wherein the solenoid-controlled actuator in the secondary state provides the piloted valve in the closed state, thereby preventing fluid communication between the first chamber and the second chamber;

ii. wherein the solenoid-controlled actuator may be switched from the secondary state to the primary state so as to coincide with a camshaft torque acting in a chosen direction, thereby switching the piloted valve to the open state and allowing fluid to flow between the first chamber and the second chamber in a direction in accordance with the chosen direction of camshaft torque, thus rotating the rotor relative to the stator;

iii. wherein the solenoid-controlled actuator may be switched from the primary state to the secondary state prior to the camshaft torque changing to a non-chosen direction, thereby switching the piloted valve to the closed state and preventing fluid flowing between the first chamber and the second chamber in an opposite direction to the direction of state ii;

iv. wherein states ii and iii may be repeated until a desired angle of the rotor relative to the stator is obtained; and v. wherein the solenoid-controlled actuator may be maintained in the secondary state, thereby providing the piloted valve in the closed state, thus preventing fluid communication between the first chamber and the second chamber, and thereby maintaining the desired angle of the rotor relative to the stator.

2. The variable cam timing phaser arrangement according to claim 1, wherein the hydraulic fluid and/or pilot fluid used in the arrangement is hydraulic oil.

3. The variable cam timing phaser arrangement according to claim 1, wherein the pilot fluid is air.

4. The variable cam timing phaser arrangement according to claim 1, wherein the piloted valve is a 2/2 way on/off valve, arranged to be normally in the open state, and actuated by increased fluid pressure at the pilot port to switch to the closed state.

5. The variable cam timing phaser arrangement according to claim 1, wherein the solenoid-controlled actuator is a 3/2 way on/off solenoid valve having an inlet port in fluid communication with a source of increased fluid pressure, an outlet port in fluid communication with the pilot port of the piloted valve, and a vent port, wherein the primary state of the solenoid valve is a de-energized state preventing fluid communication from the source of increased fluid pressure to the pilot port of the piloted valve and allowing fluid communication from the pilot port of the piloted valve to the vent port, and wherein the secondary state of the solenoid valve is an energized state allowing fluid communication from the source of increased fluid pressure to the pilot port of the piloted valve and actuating the piloted valve.

6. The variable cam timing phaser arrangement according to claim 1, wherein the solenoid-controlled actuator comprises a solenoid-driven piston arranged in a cylinder, the cylinder being arranged in fluid communication with the pilot port of the piloted valve, wherein the primary state of the solenoid-driven piston is a retracted de-energized state and the secondary state of the solenoid-driven piston is an extended energized state, the extended state increasing the pressure of the pilot fluid at the pilot port of the piloted valve and actuating the piloted valve.

7. The variable cam timing phaser arrangement according to claim 1, wherein the piloted valve is a 2/2 way on/off valve, arranged to be normally in the closed state, and actuated by decreased fluid pressure at the pilot port to switch to the open state.

8. The variable cam timing phaser arrangement according to claim 7, wherein the solenoid-controlled actuator comprises a solenoid-driven piston arranged in a cylinder, the cylinder being arranged in fluid communication with the pilot port of the piloted valve, wherein the primary state of the solenoid-driven piston is an retracted energized state and the secondary state of the solenoid-driven piston is an extended energized state, the retracted state decreasing the pressure of the pilot fluid at the pilot port of the piloted valve and actuating the piloted valve.

9. The variable cam timing phaser arrangement according to claim 8, wherein the solenoid-controlled actuator further comprises a normally open 2/2 way solenoid valve having an inlet port in fluid communication with a source of increased fluid pressure and an outlet port in fluid communication with the cylinder, wherein the primary state of the solenoid valve is a closed energized state and the secondary state of the solenoid valve is an open energized state, allowing fluid communication from the source of increased fluid pressure to the pilot port of the piloted valve.

10. The variable cam timing phaser arrangement according to claim 1, wherein a source of increased fluid pressure is arranged in fluid communication with the first chamber and the second chamber via a first refill channel and a second refill channel respectively, the first refill channel and second refill channel each having a check valve arranged to prevent fluid flow from the first chamber or second chamber to the source of increased fluid pressure.

11. The variable cam timing phaser arrangement according to claim 10, wherein a pilot check valve having a first flow port arranged in fluid communication with the piloted valve, a second flow port arranged in fluid communication with the second chamber and a pilot port arranged in fluid communication with the second refill channel, wherein the pilot check valve is arranged to be in a first state allowing flow between the piloted valve and the second chamber in any direction when a fluid pressure in the second refill channel is greater than a predetermined pressure, and to be in a second state when the fluid pressure in the second refill channel is lower than the predetermined pressure, wherein when in the second state the pilot check valve allows fluid flow only from the second chamber via the piloted valve to the first chamber, and prevents flow from the first chamber to the second chamber.

12. A method for controlling a timing of a camshaft in an internal combustion engine comprising a variable cam timing phaser arrangement, wherein said variable cam timing phaser arrangement comprises:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting a drive force, wherein the at least one vane divides the at least one recess into a first chamber and a second chamber, the first chamber and the second chamber being arranged to receive hydraulic fluid under pressure wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said control assembly comprising:

an on/off piloted valve located centrally within the rotor or camshaft, the piloted valve comprising a pilot port, a first flow port and a second flow port, the first flow port being in fluid communication with the first chamber and the second flow port being in fluid communication with the second chamber, wherein the piloted valve is switchable between an open state and a closed state by regulation of a pressure of a pilot fluid at the pilot port, wherein in the open state the piloted valve allows fluid communication between the first chamber and second chamber, and in the closed state the piloted valve prevents fluid communication between the first chamber and the second chamber; and a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port, wherein the method comprises:

i. providing the solenoid-controlled actuator in the secondary state, thereby providing the piloted valve in the closed state, thus preventing fluid communication between the first chamber and the second chamber;

ii. timing a switching of the solenoid-controlled actuator from the secondary state to the primary state to coincide with a camshaft torque acting in a chosen direction, thereby switching the piloted valve to the open state and allowing fluid to flow between the first chamber and the second chamber in a direction in accordance with the chosen direction of camshaft torque, thus rotating the rotor relative to the stator;

iii. switching the solenoid-controlled actuator from the primary state to the secondary state prior to the camshaft torque changing to a non-chosen direction, thereby switching the piloted valve to the closed state and preventing fluid flowing between the first chamber and the second chamber in an opposite direction to the direction of step ii;

iv. repeating steps ii and iii until a desired angle of the rotor relative to the stator is obtained; and v. maintaining the solenoid-controlled actuator in the secondary state, thereby providing the piloted valve in the closed state, thus preventing fluid communication between the first chamber and the second chamber, and thereby maintaining the desired angle of the rotor relative to the stator.

13. The method according to claim 12, wherein the switching of the solenoid-controlled actuator in step ii. is timed to coincide with the camshaft torque increasing over a threshold value and the switching of the solenoid-controlled actuator in step iii. is timed to coincide with the camshaft torque decreasing under a threshold value.

14. An internal combustion engine comprising a variable cam timing phaser arrangement, wherein said variable cam timing phaser arrangement comprises:

a rotor having at least one vane, the rotor arranged to be connected to a camshaft of the combustion engine;

a stator co-axially surrounding the rotor, having at least one recess for receiving the at least one vane of the rotor and allowing rotational movement of the rotor with respect to the stator, the stator having an outer circumference arranged for accepting a drive force, wherein the at least one vane divides the at least one recess into a first chamber and a second chamber, the first chamber and the second chamber being arranged to receive hydraulic fluid under pressure wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said control assembly comprising:

an on/off piloted valve located centrally within the rotor or camshaft of the combustion engine, the piloted valve comprising a pilot port, a first flow port and a second flow port, the first flow port being in fluid communication with the first chamber and the second flow port being in fluid communication with the second chamber, wherein the piloted valve is switchable between an open state and a closed state by regulation of a pressure of a pilot fluid at the pilot port, wherein in the open state the piloted valve allows fluid communication between the first chamber and second chamber, and in the closed state the piloted valve prevents fluid communication between the first chamber and the second chamber; and a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port, i. wherein the solenoid-controlled actuator in the secondary state provides the piloted valve in the closed state, thereby preventing fluid communication between the first chamber and the second chamber;

ii. wherein the solenoid-controlled actuator may be switched from the secondary state to the primary state so as to coincide with a camshaft torque acting in a chosen direction, thereby switching the piloted valve to the open state and allowing fluid to flow between the first chamber and the second chamber in a direction in accordance with the chosen direction of camshaft torque, thus rotating the rotor relative to the stator;

iii. wherein the solenoid-controlled actuator may be switched from the primary state to the secondary state prior to the camshaft torque changing to a non-chosen direction, thereby switching the piloted valve to the closed state and preventing fluid flowing between the first chamber and the second chamber in an opposite direction to the direction of state ii;

iv. wherein states ii and iii may be repeated until a desired angle of the rotor relative to the stator is obtained; and v. wherein the solenoid-controlled actuator may be maintained in the secondary state, thereby providing the piloted valve in the closed state, thus preventing fluid communication between the first chamber and the second chamber, and thereby maintaining the desired angle of the rotor relative to the stator.

15. A vehicle comprising a combustion engine and a variable cam timing phaser arrangement, wherein said variable cam timing phaser arrangement comprises:

a rotor having at least one vane, the rotor arranged to be connected to a camshaft of the combustion engine of the vehicle;

a stator co-axially surrounding the rotor, having at least one recess for receiving the at least one vane of the rotor and allowing rotational movement of the rotor with respect to the stator, the stator having an outer circumference arranged for accepting a drive force, wherein the at least one vane divides the at least one recess into a first chamber and a second chamber, the first chamber and the second chamber being arranged to receive hydraulic fluid under pressure wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa, said control assembly comprising:

an on/off piloted valve located centrally within the rotor or camshaft of the combustion engine of the vehicle, the piloted valve comprising a pilot port, a first flow port and a second flow port, the first flow port being in fluid communication with the first chamber and the second flow port being in fluid communication with the second chamber, wherein the piloted valve is switchable between an open state and a closed state by regulation of a pressure of a pilot fluid at the pilot port, wherein in the open state the piloted valve allows fluid communication between the first chamber and second chamber, and in the closed state the piloted valve prevents fluid communication between the first chamber and the second chamber; and a solenoid-controlled actuator located remotely from rotating components of the variable cam timing phaser arrangement and in fluid communication with the pilot port of the piloted valve, the solenoid-controlled actuator having at least two states, a primary state and a secondary state, wherein the solenoid-controlled actuator is arranged to switch the piloted valve from the open state to the closed state when the solenoid-controlled actuator switches from the primary state to the secondary state, and wherein the solenoid-controlled actuator is arranged to switch the piloted valve from the closed state to the open state when the solenoid-controlled actuator switches from the secondary state to the primary state, by regulating the pressure of the pilot fluid at the pilot port, i. wherein the solenoid-controlled actuator in the secondary state provides the piloted valve in the closed state, thereby preventing fluid communication between the first chamber and the second chamber;

ii. wherein the solenoid-controlled actuator may be switched from the secondary state to the primary state so as to coincide with a camshaft torque acting in a chosen direction, thereby switching the piloted valve to the open state and allowing fluid to flow between the first chamber and the second chamber in a direction in accordance with the chosen direction of camshaft torque, thus rotating the rotor relative to the stator;

iii. wherein the solenoid-controlled actuator may be switched from the primary state to the secondary state prior to the camshaft torque changing to a non-chosen direction, thereby switching the piloted valve to the closed state and preventing fluid flowing between the first chamber and the second chamber in an opposite direction to the direction of state ii.

iv. wherein states ii and iii may be repeated until a desired angle of the rotor relative to the stator is obtained; and v. wherein the solenoid-controlled actuator may be maintained in the secondary state, thereby providing the piloted valve in the closed state, thus preventing fluid communication between the first chamber and the second chamber, and thereby maintaining the desired angle of the rotor relative to the stator.

* * * * *